US009180605B2

(12) United States Patent
Long

(10) Patent No.: US 9,180,605 B2
(45) Date of Patent: Nov. 10, 2015

(54) VOLUMETRIC CONCRETE MIXING METHOD AND APPARATUS

(75) Inventor: Richard L. Long, Osceola, IA (US)

(73) Assignee: CEMEN TECH, INC., Indianola, IA (US)

( * ) Notice: Subject to any disclaimer, the term of this patent is extended or adjusted under 35 U.S.C. 154(b) by 839 days.

(21) Appl. No.: 12/355,372

(22) Filed: Jan. 16, 2009

(65) Prior Publication Data

US 2009/0180348 A1 Jul. 16, 2009

Related U.S. Application Data

(60) Provisional application No. 61/021,457, filed on Jan. 16, 2008.

(51) Int. Cl.
*B28C 7/06* (2006.01)
*B28C 9/04* (2006.01)
*B28C 7/04* (2006.01)

(52) U.S. Cl.
CPC ..... *B28C 9/0463* (2013.01); *B28C 7/0418* (2013.01); *B28C 7/0422* (2013.01)

(58) Field of Classification Search
CPC ..... B28C 7/0418; B28C 7/0422; B28C 7/044
USPC ..... 366/8, 18
See application file for complete search history.

(56) References Cited

U.S. PATENT DOCUMENTS 3,380,717 A * 4/1968 Adams ..... 366/18
3,456,925 A * 7/1969 Gallagher ..... 366/27
3,661,365 A * 5/1972 Cloud, Jr. ..... 366/18
3,869,110 A * 3/1975 Brock et al. ..... 366/8
4,189,237 A * 2/1980 Bake ..... 366/2
4,218,145 A * 8/1980 Brock et al. ..... 366/18
4,222,498 A * 9/1980 Brock ..... 222/58
5,121,989 A 6/1992 Horton et al.
5,522,658 A * 6/1996 John ..... 366/15
5,590,976 A * 1/1997 Kilheffer et al. ..... 404/72
5,605,397 A * 2/1997 Oberg et al. ..... 366/2
5,709,466 A * 1/1998 Weszely ..... 366/30
5,730,523 A 3/1998 Flood (Continued)

FOREIGN PATENT DOCUMENTS

EP 394785 A1 * 10/1990 ..... B28C 7/00
EP 428419 A2 * 5/1991 ..... B01F 13/10
WO WO 01/76839 A2 10/2001
WO WO 2006/005946 1/2006

OTHER PUBLICATIONS

Nilkanth Engineering Works, "Reversible Concrete Mixer", www.nilkanthengg.com/reversible-concrete-mixer.html. (2 pages) Accessed from the Internet Nov. 5, 2007.

(Continued)

*Primary Examiner* — James Sanders
(74) *Attorney, Agent, or Firm* — McKee, Voorhees & Sease, PLC

(57) ABSTRACT

An improved volumetric concrete mixing system and method of the present invention utilizes load cells for measuring weight loss from the aggregate and cement bins. Load cells may also be used for measuring weight loss from the water tank. The load cells provide input data corresponding to the weight loss of each container to a controller which automatically adjusts the delivery of ingredients to a mixing boot so as to achieve a desired concrete mix ratio.

14 Claims, 9 Drawing Sheets

(56) References Cited

U.S. PATENT DOCUMENTS

| | | | | |
|---|---|---|---|---|
| 5,971,600 | A * | 10/1999 | Paterson et al. | 366/150.1 |
| 6,876,904 | B2 | 4/2005 | Oberg et al. | |
| 2003/0002384 | A1* | 1/2003 | Flood | 366/7 |
| 2003/0142579 | A1* | 7/2003 | Throop | 366/3 |
| 2003/0227814 | A1* | 12/2003 | Priesnitz et al. | 366/2 |
| 2007/0189109 | A1* | 8/2007 | Long | 366/42 |
| 2007/0257392 | A1* | 11/2007 | Etherton | 264/49 |

OTHER PUBLICATIONS

Scale-Tron, "Custom Weighing Systems", www.scaletron.com/code/custom.htm. (4 pages) Access from the Internet Nov. 5, 2007.

Macons, "Horizontal Plant—MCP Bin Series", www.macons.co.in/products.htm. (2 pages) Accessed from the Internet Nov. 5, 2007.

* cited by examiner

VOLUMETRIC CONCRETE MIXING METHOD AND APPARATUS

CROSS-REFERENCE TO RELATED APPLICATIONS

This application claims priority under 35 U.S.C. §119(e) to provisional application Ser. No. 61/021,457 filed Jan. 16, 2008, herein incorporated by reference in its entirety.

BACKGROUND OF THE INVENTION

Concrete is a mixture of paste and aggregates. The paste is composed of cement and water. The most common cement is Portland cement, although other cementous materials may be used, such as fly ash, ground slag, and silica fume. The aggregates may include both fine and course aggregates, such as sand and rocks, respectively. Freshly mixed, uncured concrete is plastic. It can be molded or formed into any shape, which becomes strong and durable when hardened. Careful proportioning and mixing of the ingredients is key to producing strong, durable concrete. A concrete mixture with insufficient paste to fill the voids between the aggregates will be difficult to place, and will produce rough, honey combed surfaces and porous concrete. A mixture with excessive paste is easy to place and produces a smooth surface, but produces concrete that is likely to crack. Thus, the desired workability for the fresh concrete and the required durability and strength for the hardened concrete depends on properly proportioning the ingredients. Generally, a concrete mixture contains approximately 10%-15% cement, 60%-75% aggregates, and 15%-20% water, by volume. Air may also be introduced into the mixture at 5%-8% by volume.

The quality of the paste determines the character of the concrete. The paste strength depends on the water to cement ratio. Ideally, the water to cement ratio is lowered as much as possible to produce high quality concrete, without sacrificing the workability of the uncured mixture.

Concrete can be produced at a stationary plant, with a ready-mix truck, or a volumetric mixing system. A stationary plant includes all the storage, mixing and delivery components assembled at the job site to produce concrete for extended periods of time. Ready-mix refers to concrete that is from a central stationary plant, wherein the aggregate, cement and water are mixed in a rotating barrel on a truck which delivers the slurry to the job site, rather than being mixed at the job site. Ready mix is advantageous for small jobs when intermittent placing of concrete is required. In volumetric systems, the aggregate, cement and water are stored in separate bins or compartments on a truck, and then mixed together at the job site in a mixing boot on the end of the truck.

In conventional volumetric mixing systems, the sand and rock aggregates pass through a pair of gates for discharge onto a conveyor belt. The volume of the respective aggregates can be controlled by adjusting the gate opening to achieve the desired concrete mix design. The truck also includes a cement bin with an auger that discharges the cement into the aggregate mixture. These solid ingredients are measured in a volumetric manner to regulate the mixed design. For example, the volume of each ingredient can be calculated by the size of the respective gate opening, the speed of the cement auger, and the speed of the conveyor. However, if the sand, aggregate or cement bridges in their bin so that delivery to the conveyor is not complete, the desired mix ratio is not achieved. Therefore, the operator normally must watch the slurry discharged from the mixing boot to assure consistent slump. If a change in slump is noticed, the operator must determine the cause and solve the problem, such as breaking up the bridged ingredient. Such a fix often requires the mixer to be shut down temporarily, thus slowing down the whole concrete operation.

Even when everything is operating correctly such that the volume measurements are relatively accurate, new standards requiring greater accuracy cannot be achieved with conventional volumetric measurement of the aggregates and cement.

Therefore, a primary objective of the present invention is the provision of an improved volumetric concrete mixing system and method using load cells to perform a weight loss function for aggregates and cement.

Another objective of the present invention is the provision of an improved volumetric concrete truck having aggregate bins and a cement bin which are independently mounted from one another for independent weight measurements of the bin contents.

Yet another objective of the present invention is the provision of an improved volumetric concrete truck having a programmable control to receive data corresponding to ingredient weight measurements and adjusting ingredient delivery to achieve a desired concrete mix specification.

Still another objective of the present invention is the provision of an improved volumetric concrete mixing system and method which automatically and accurately determines the weight of materials delivered from the dry ingredient storage bins to the mixing boot.

A further objective of the present invention is the provision of an improved volumetric concrete mixing system which automatically adjusts the delivery of aggregate and cement to maintain a desired mix ratio.

Another objective of the present invention is the provision of an improved volumetric concrete mixing system which eliminates or minimizes the need for an operator to monitor the mix slurry.

Still another objective of the present invention is the provision of an improved volumetric concrete mixing system and method which quickly and easily allows for a change of mix ratios.

These and other objectives will become apparent from the following description of the invention.

DESCRIPTION OF THE INVENTION

Figure 1:
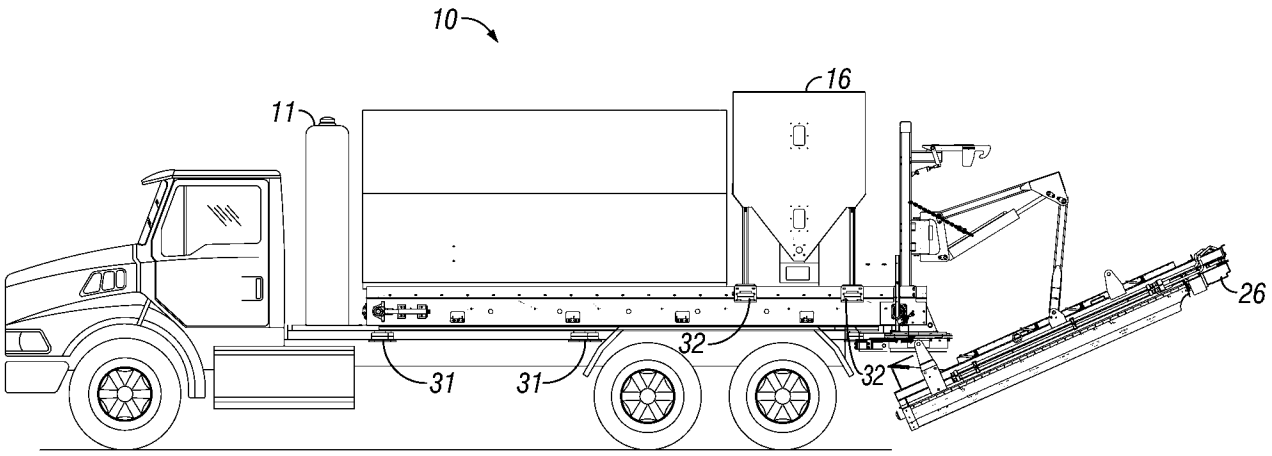
FIG. 1 is a perspective view of a volumetric cement truck according to the present invention.
Figure 2:
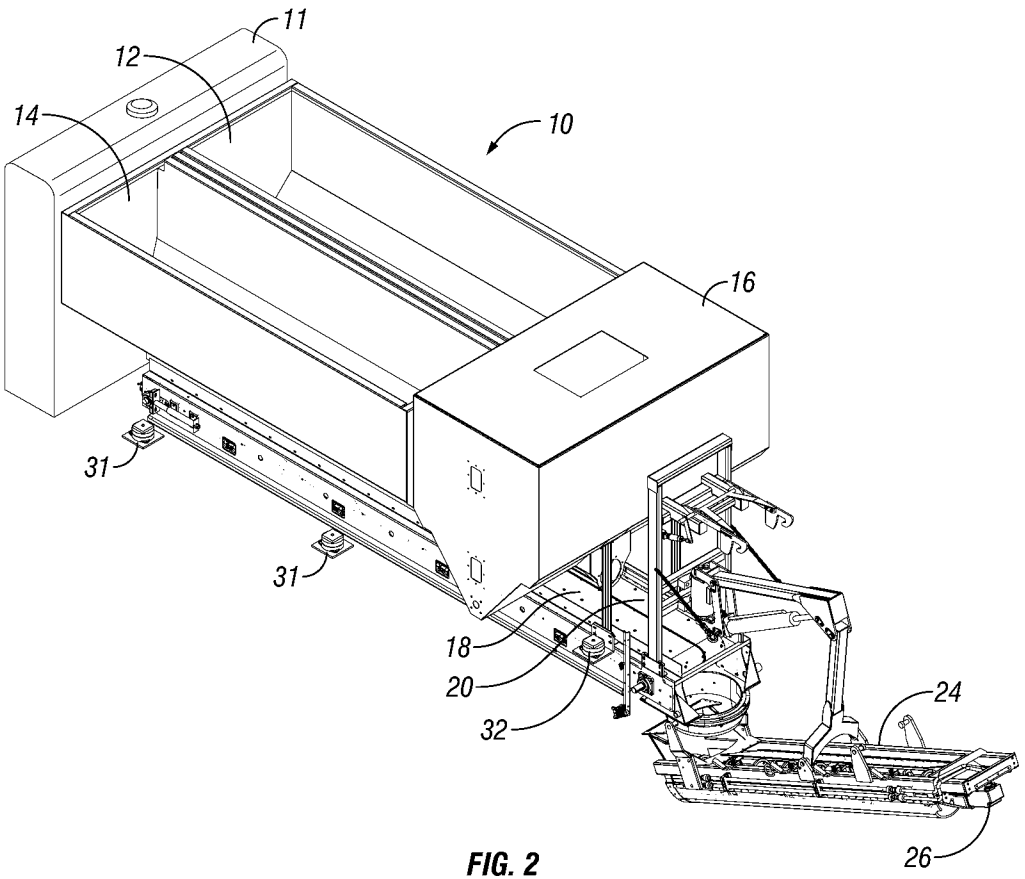
FIG. 2 is a perspective view of the aggregate and cement bins with the load cells of the present invention, with the truck cab, frame and wheels removed for clarity.
Figure 3:
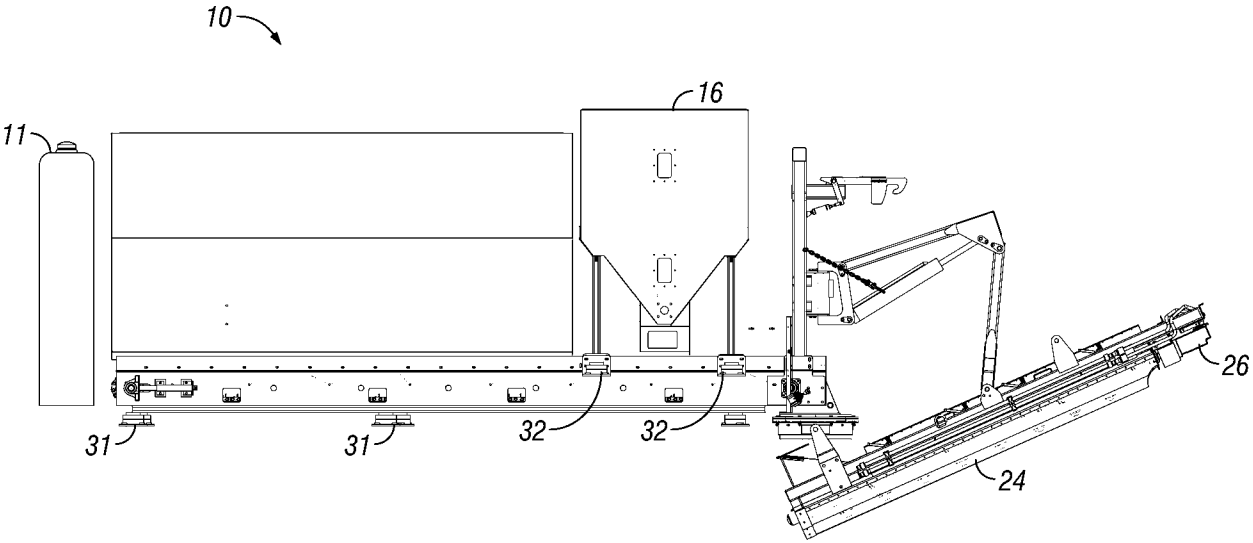
FIGS. 3 and 4 are side elevation views from opposite sides of the bins.
Figure 4:
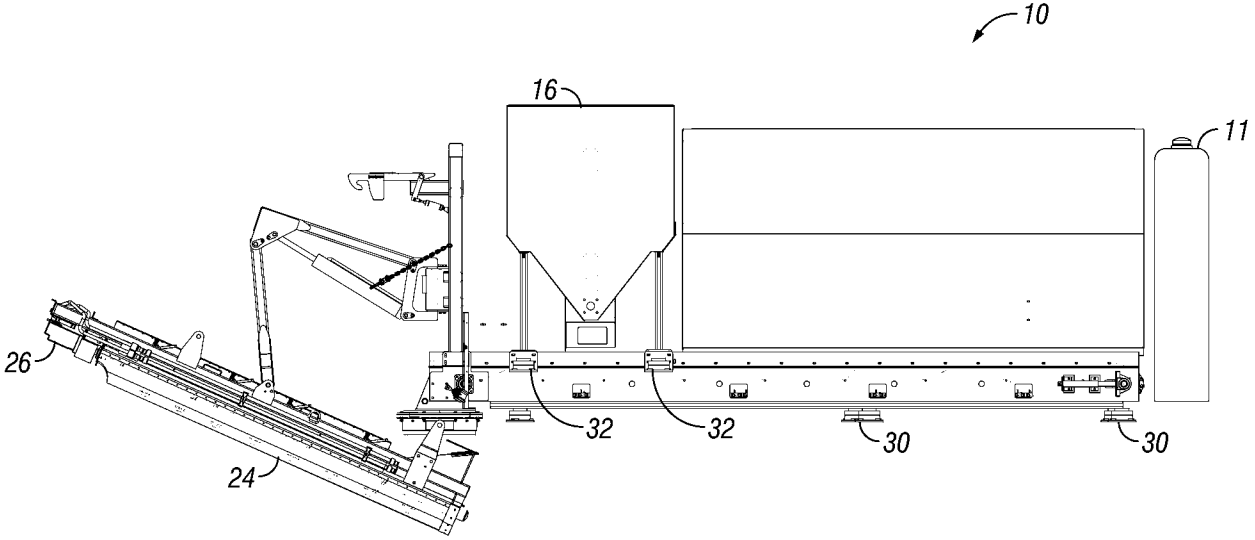
Figure 5:
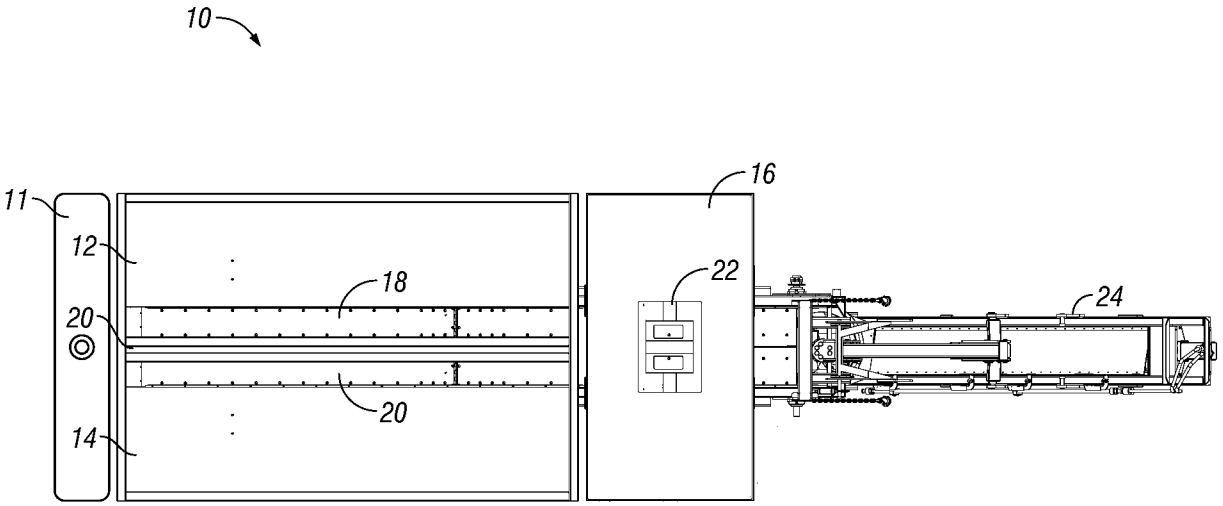
FIG. 5 is a top plan view of the bins.
Figure 6:
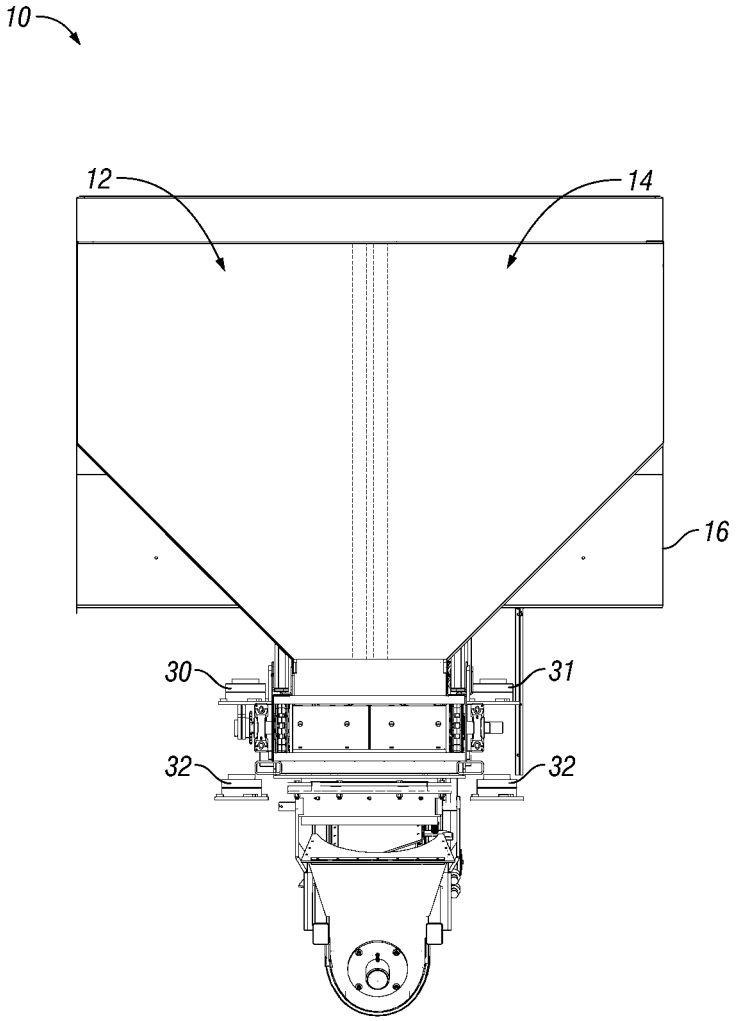
FIG. 6 is a view from the front end of the bins, with the water tank not shown for clarity.
Figure 7:
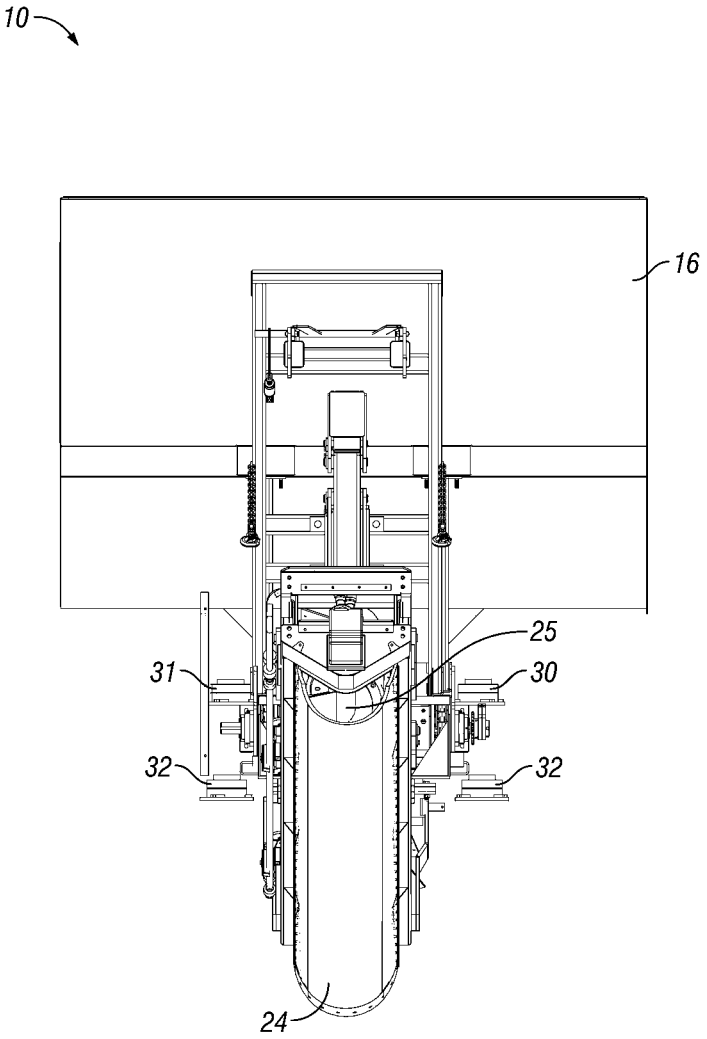
FIG. 7 is a view from the rear of the bins.
Figure 8:
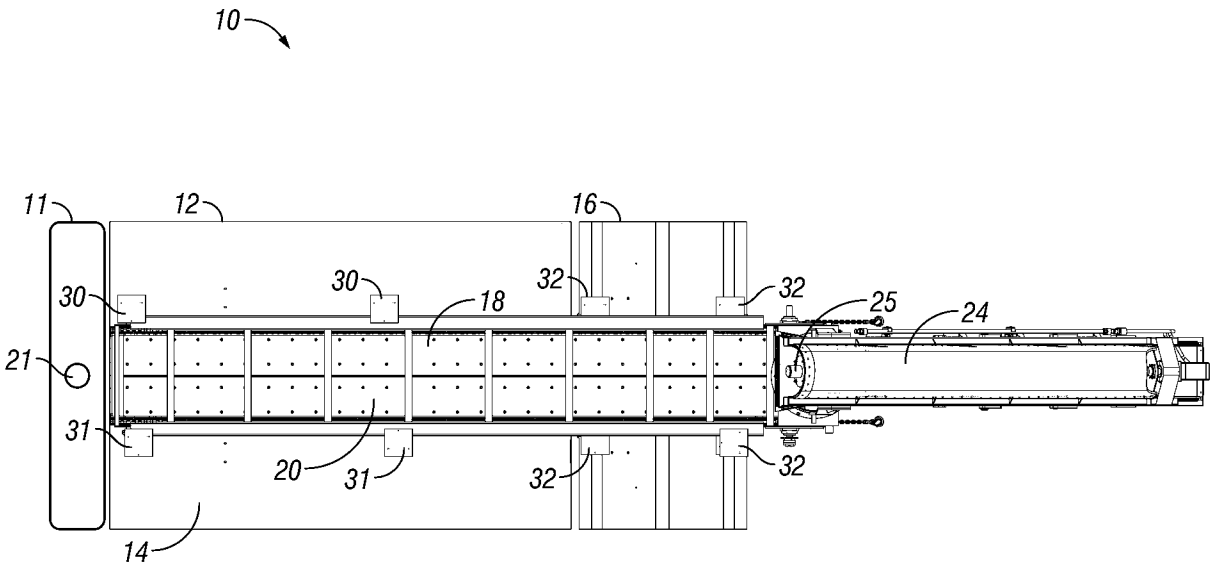
FIG. 8 is a bottom plan view of the bins.
Figure 9:
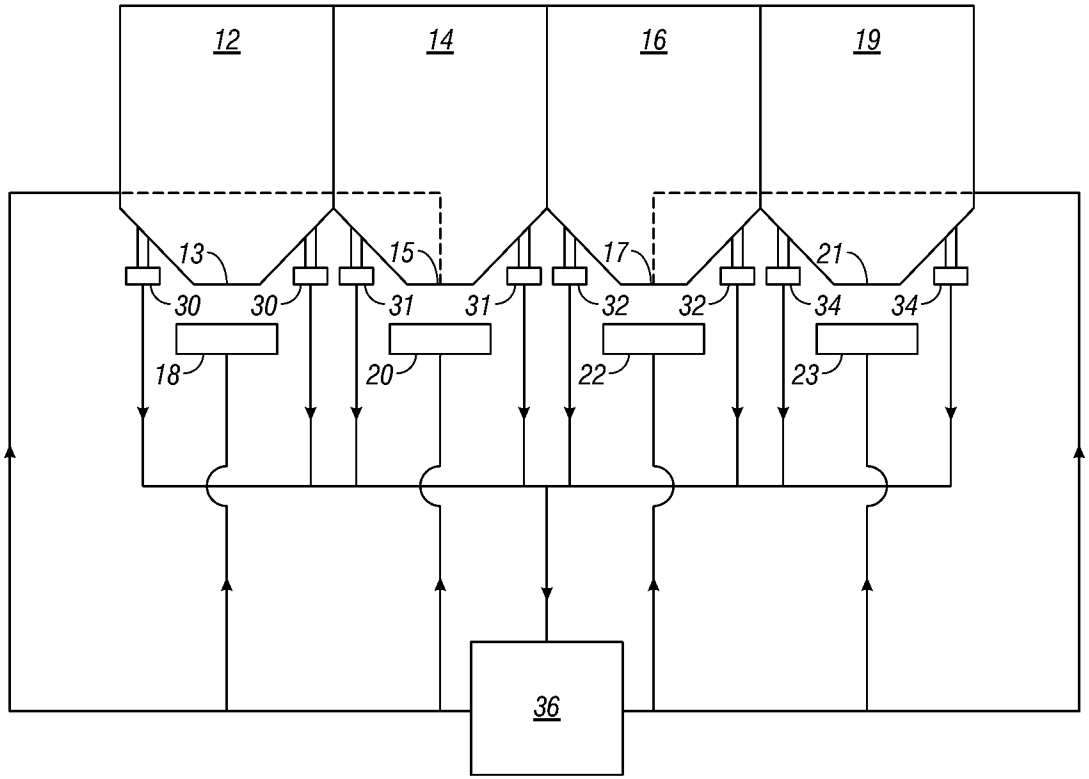
FIG. 9 is a schematic view showing the controller for receiving data from the load cells and providing feedback to the gates, augers, and/or conveyors of the mixing system.

The volumetric concrete mixing truck of the present invention is generally designated by the reference numeral 10, and includes a water tank 11, and first and second bins 12, 14 for holding aggregate materials, such as sand and rock, respectively. A bin 16 for cement is also provided on the truck 10. The bins 12, 14, 16 are independently mounted on the truck 10 and are not secured together or otherwise connected so that the weight of each bin can be separately determined, as discussed below. A pair of belt conveyors 18, 20 extend side-by-side beneath the bins 12, 14, respectively, and beneath the bin 16, for conveying aggregate and cement rearwardly. The cement bin 16 includes an auger 22 for discharging cement onto one or both of the conveyor belts 18, 20. The aggregate bins 12, 14 each have an adjustable gate 13, 15, respectively to control discharge of material onto the conveyors 18, 20. The cement bin may also include an adjustable gate 17 to control discharge of cement into the auger 22. Plumbing is also provided on the truck for the water tank 11. A valve 21 and/or a pump 23 controls the delivery of water from the tank 11. At the rear of the mixer truck 10 is a mixing boot 24 with an internal auger 25 which is driven in any convenient means so as to mix the sand, gravel, cement and water delivered to the boot 24. When the mixing is complete, the wet concrete slurry is expelled through an outlet chute 26 on the end of the boot 24.

The mixer truck 10 includes hydraulic weigh or load cells positioned beneath the respective bins for performing a weight loss measurement of the ingredients so as to accurately regulate the mix design. Preferably, there are four load cells 30 for the rock bin 12, four load cells 31 for the sand bin 14, and four load cells 32 for the cement bin 16. Four load cells 34 may also be provided for the water tank 11. The load cells 30, 31, 32 and 34 measure the loss in weight in the respective bin or tank. An alternative to water tank load cell is the use of a water flow meter. The load cells are mounted to the bins in any convenient manner so as to avoid or minimize effects of vibration when the truck 10 is moving.

The mixing system of the present invention also includes a controller 36, such as a programmable logic controller, microprocessor, or computer, which receives data from the load cells 30, 31, 32 and 34 and provides feedback to the gates 13, 15, 17, 21, the conveyors 18, 20, the auger 22, and/or the pump 23 so as to adjust the amount of rock, sand, cement, and/or water delivered to the mixing boot 24. In addition to the controller 36, a summing box may be provided for each set of load cells 30, 31, 32 and 34 so as average the weights sensed by each cell in a set. The controller 36 is preprogrammed so that an operator can select the desired mix ratio of the various ingredients and then provide feedback signals to adjust the size of the gate openings and/or speed of the dry ingredient conveyors and/or water pump. If the weight of any ingredient does not match the preprogrammed weight for the selected mix specification, the controller 36 will make the appropriate adjustments to bring the mix back to the desired specification. For example, if bridging occurs in one of the dry bins 12, 14 or 16, the associated load cell 30, 31, 32 will sense the weight and the signal to the controller 36 will indicate a problem, and shut down the mixing process until the operator breaks the bridge. The control system 36 also allows adjustments to the mix ratio to be made on the fly during the mixing process.

Another advantage of the present invention is that the operator can select one mix ratio for a first job site and a different mix ratio for a second job site, each of which use less than the full load of the truck. Similarly, mix ratios can be varied at a single job site, as needed.

Thus, the controller 36 adjusts the delivery of the various ingredients by adjusting the speeds of the conveyor belts 18, 20 or the auger 22 or the pump 23, or alternatively adjusting the opening size of the gates 13, 15, 17 or the valve 21. The controller 36 can be programmed to take readings at various periodic intervals, at the operator's discretion. For example, the controller 36 may cycle once per second or 100 times per second. In conventional volumetric mix operations, the gate size and the conveyor speed must be calibrated for each concrete mix ratio. Such calibrations are unnecessary with the improved mixing system and method of the present invention, wherein the controller 36 automatically calibrates the gate sizes and conveyor or pump speeds.

It is understood that the system shown in the drawings and described above can be varied without departing from the scope of the present invention. For example, more or less load cells may be provided on each bin. Another variation of the present invention is to weigh one or more bins together, for example, the rock and sand bins 12, 14 being formed as one unit with a shared dividing wall to define separate compartments, as in conventional volumetric concrete trucks. Also, different types of conveyors may be utilized for transporting the ingredients from their respective bins or tanks to the mixing boot. Also, the orientation of the bins may be altered from that shown in the drawings.

By weighing the loss in weight from the various bins to measure the aggregate, cement and/or water in the concrete slurry, the ingredients can be adjusted so as to achieve a desired mix specification. Such weight loss measurements are more accurate than prior art volume measurement.

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

What is claimed is:

1. A volumetric concrete mixing method, comprising:

delivering aggregate from an aggregate bin onto an aggregate conveyor;

delivering sand from a sand bin onto a sand conveyor;

the aggregate and sand conveyors being arranged side-by-side and being operative independent of one another;

delivering cement from a cement bin onto at least one of the aggregate and sand conveyors;

the aggregate, sand and cement bins being independently mounted on a volumetric concrete mixing truck;

transporting the aggregate, sand and cement on the conveyors to a mixing boot on the end of the truck;

adding water from a water tank on the truck to the mixing boot;

mechanically mixing the aggregate, sand, cement and water in the boot to produce a mixed concrete slurry ready for pouring at a job site;

weighing the loss in weight from the bins and the tank using load cells to measure the aggregate, sand, cement and water in the concrete slurry;

weighing the aggregate weight loss with a first load cell, weighing the sand weight loss with a second load cell, weighing the water weight loss with a third load cell, and weighing the cement weight loss with a fourth load cell;

weighing the bins separately to determine the weight loss of aggregate, sand, water, and cement, respectively;

the load cells for each bin and the tank being independent of one another; and adjusting the supply of aggregate, sand, cement, and/or water in response to weight data from the four load cells to achieve a desired concrete mixture specification;

wherein a controller automatically calibrates process equipment including bin gate sizes, conveyors and pumps for a given concrete mix ratio.

2. The method of claim 1 wherein the slurry is made at the job site.

3. The method of claim 1 wherein the weighing steps are performed at the job site.

4. The method of claim 1 further comprising inputting data corresponding to the weight loss into a controller and adjusting the delivery of aggregate and/or cement to achieve the desired mixture specification.

5. The method of claim 1 wherein the adjustment includes changing the delivery rate of the aggregate, sand, cement and/or water to the boot.

6. The method of claim 1 wherein the adjustment includes changing the discharge rate of the aggregate, sand, cement, and/or water from the respective bins and/or tank.

7. The method of claim 1 wherein the adjustment includes changing the speed of one or more of the conveyors.

8. The method of claim 1 further comprising a gate on each of the bins and on the tank, and the adjustment including changing the position of one or more of the gates.

9. The method of claim 1 further comprising a gate on each of the bins and on the tank, and a controller operatively connected to the load cells, the gates and the conveyors, and wherein the adjustment includes receiving data at the controller from the load cells and providing feedback from the controller to the gates and/or the conveyors.

10. The method of claim 1 further comprising preprogramming a controller for a selected concrete mix specification having a specific weight for each of the aggregate, sand, cement and water components, and the adjustment being automatically made by the controller if the weights sensed by the load cells do not match the preprogrammed weights.

11. A volumetric concrete mixing method, comprising:

depositing sand and aggregate from independent sand and aggregate bins on a truck frame onto independent sand and aggregate conveyors, respectively, running side by side and rearwardly;

depositing cement from an independent cement bin on the truck frame to one of the sand and aggregate conveyors;

discharging the sand, aggregate and cement from the conveyors into a mixing boot at the rear of the truck frame;

adding water from an independent tank on the truck frame into the mixing boot;

mixing the sand, aggregate, cement and water with an auger in the mixing boot to produce a concrete slurry ready for pouring;

discharging the slurry from the mixing boot;

separately weighing the sand, aggregate and cement bins and the water tank;

generating weight data for the sand, aggregate, cement and water; and controlling the mixture of the sand, aggregate, cement and water in response to the weight data without monitoring the discharged slurry;

wherein a controller automatically calibrates process equipment including bin gate sizes, conveyors and pumps for a given concrete mix ratio.

12. The method of claim 11 further comprising separately adjusting the speed of the sand and aggregate conveyors.

13. The method of claim 1 wherein the adjustment step is performed without monitoring the mixed concrete slurry.

14. The method of claim 1 wherein the adjustment step is performed independently from the mixing step.

* * * * *